US009022014B2

(12) United States Patent
Hu

(10) Patent No.: US 9,022,014 B2
(45) Date of Patent: May 5, 2015

(54) ELECTRIC TOY GUN

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 116 days.

(21) Appl. No.: 13/964,224

(22) Filed: Aug. 12, 2013

(65) Prior Publication Data

US 2014/0338648 A1 Nov. 20, 2014

(30) Foreign Application Priority Data

May 15, 2013 (TW) ..... 102117159 A

(51) Int. Cl.
*F41B 11/71* (2013.01)
*F41A 19/02* (2006.01)
*F41B 11/646* (2013.01)

(52) U.S. Cl.
CPC ..... *F41B 11/71* (2013.01); *F41A 19/02* (2013.01); *F41B 11/646* (2013.01)

(58) Field of Classification Search
CPC ..... F41B 11/00; A63B 69/40
USPC ..... 124/32, 31, 36; 446/473; 89/132, 135, 89/136; 74/10.39, 10.9, 30, 29, 45, 72, 21
See application file for complete search history.

(56) References Cited

U.S. PATENT DOCUMENTS

| | | | | |
|---|---|---|---|---|
| 2,548,622 | A * | 4/1951 | Sampson et al. | 42/69.02 |
| 2,896,604 | A * | 7/1959 | Rebikoff | 124/22 |
| 3,026,640 | A * | 3/1962 | Ogdon | 40/502 |
| 5,184,756 | A * | 2/1993 | Amron | 222/79 |
| 7,100,592 | B1 * | 9/2006 | Yang | 124/67 |
| 2006/0137671 | A1 * | 6/2006 | Chu | 124/32 |
| 2012/0192709 | A1 * | 8/2012 | Troy et al. | 89/132 |

* cited by examiner

*Primary Examiner* — Gene Kim
*Assistant Examiner* — Jeffrey Vanderveen
(74) *Attorney, Agent, or Firm* — Rosenberg, Klein & Lee

(57) ABSTRACT

An electric toy gun with a plurality of firing modes includes a trigger, a power break holder, a power contact holder, a block member slidably coupled to the power break holder and having a first tooth and a second tooth at one lateral side thereof, a swing bar having an actuation portion and a push block connected to the actuation portion. A control mechanism enables the push block of the swing bar to be shifted to the rear side of the first tooth, the rear or front side of the second tooth. Lowering of the power break holder with the block member drives the push block to move the first or second tooth forward and then to push the first tooth forward. The block member is displaced relative to the stop portion of the link which moves the power break holder.

14 Claims, 12 Drawing Sheets

ELECTRIC TOY GUN

BACKGROUND OF THE INVENTION

1. Field of the Invention

The present invention relates to electric toy gun technology, and more particularly to such an electric toy gun, which provides optional single fire, dual fire and continuous fire modes.

2. Description of the Prior Art

The driving principle of an electric toy gun is completely different from that of an air-soft toy gun. When the trigger of an electric toy gun is pressed, a power break holder is moved into contact with a power contact holder in the inside of the gun body to start the firing mechanism. Similar designs are seen in Taiwan Patent No. M389249 (equivalent to U.S. Pat. No. 8,146,577 or European Patent No. 2,390,614) entitled "Electric toy gun with an improved power break control mechanism" and Taiwan Patent No. M395150 (equivalent to U.S. Pat. No. 8,091,542) entitled "Electric toy gun with a power break control mechanism". When firing, a battery-operated gearwheel set 10 is driven by a motor to move a piston set 30 toward the rear side in the gun body 20 (see FIG. 1). The piston set 30 has a return spring 301 loaded thereon. When rotating the gearwheel set 10 to a predetermined position, the piston set 30 is released from the gearwheel set 10, and the return spring 301 immediately returns the piston set 30 forwards to its former position, allowing discharge of a compressed gas to drive a toy bullet out of the gun barrel. Thus, one firing action is done, and the toy gun is reset for a next firing action. The above description explains the electric conduction and bullet firing operation of the prior art electric toy gun.

Further, when designing a toy gun, every manufacturer is trying hard to provide a high level of realistic simulation, making the outer appearance of the electric toy gun similar to a real gun. A toy gun can be configured to provide a single fire mode, a continuous fire mode, and a backlash vibration mode. However, no any commercial toy gun is capable of providing a single fire mode, a dual fire mode and a continuous fire mode for selection. Further, among the variously known special toy guns (for example, the pneumatic submachine gun of Taiwan Patent publication No. 201315961, issued to the present inventor), no any electric toy gun provides a single fire mode, a dual fire mode and a continuous fire mode. Therefore, there is a strong demand for electric toy gun that provides a single fire mode, a dual fire mode and a continuous fire mode for selection.

SUMMARY OF THE INVENTION

The present invention has been accomplished under the circumstances in view. It is one object of the present invention to provide an electric toy gun, which has the internal structure thereof so arranged to provide optional single fire, dual fire and continuous fire modes.

To achieve this and other objects of the present invention, an electric toy gun with optional single fire, dual fire and continuous fire modes of the present invention comprises a trigger coupled, a link, a power break holder, a power contact holder, a gearwheel set, a swing bar and a control mechanism. The link is coupled between the trigger and the power break holder. When the trigger is pressed, the link is forced to move the power break holder into contact with the power contact holder electrically, and at the same time, the gearwheel set is forced to rotate, causing the swing bar to swing back and forth. The swing bar has its top side terminating in an actuation portion. Further, the power break holder is elastically movable back from the power contact holder to its former position to cut off power supply.

The invention is characterized by the following features. The link comprises a coupling portion and a stop portion. The coupling portion is pivotally connected to the trigger such that when the trigger is pressed by an external force, the coupling portion is lifted, and the stop portion is lowered. Further, the power break holder comprises a block member horizontally slidably coupled to a top side thereof. The block member comprises a first tooth and a second tooth at one lateral side thereof. The second tooth is disposed at a front side relative to the first tooth. The block member is movable downwardly by the stop portion to lower the power break holder into contact with the power contact holder and to further turn on the power supply. The block member is disposed at one lateral side relative to the actuation portion of the swing bar when moved down by the stop portion. The swing bar comprises a push block connected to the actuation portion. The control mechanism is controllable to move the block member in one of three positions, enabling the push block to be selectively shifted to a rear side relative to the first tooth, a rear side relative to the second tooth or a front side relative to the second tooth when the power break holder and the block member are lowered. When the push block is at the rear side relative to the first tooth and the swing bar is moved to push the actuation portion forward, the push block pushes the first tooth forward, causing the block member to be moved forwardly away from the stop portion of the link and the power break holder to be moved away from the power contact holder to turn off the power supply. When the push block is at the rear side relative to the second tooth and the swing bar is moved to push the actuation portion forward, the push block pushes the second tooth, causing the block member to be moved forward and the push block to be forced move to the rear side relative to the first tooth, and the swing bar is moved again to force the push block of the actuation portion to push the first tooth forward, causing the block member to be moved away from the stop portion of the link and the power break holder to be moved away from the power contact holder to turn off the power supply. When the push block is at the front side relative to the second tooth and the swing bar is moved to push the actuation portion forward, the push block is kept away from the first tooth and the second tooth and the actuation portion of the swing bar is continuously moved back and forth, and the coupling portion of the link is lowered and the stop portion is lifted when the trigger is released, and therefore the power break holder is moved upwardly away from the power contact holder to turn off the power supply.

Further, the block member is disposed above the power break holder. Further, a first return spring is horizontally provided between the block member and the power break holder for enabling the block member to be automatically returned after the block member having been moved forward.

Further, the first tooth of the block member has a beveled edge located at a front side thereof. Further, a second return spring is provided between the push block and the actuation portion of the swing bar such that when the power break holder and the block member are lowered and the push block is moved to the rear side relative to the second tooth, the push block pushes the second tooth to move the block member forward, and then the second return spring forces the push block to move along the beveled edge to the rear side relative to the first tooth.

Further, the control mechanism comprises a rotating shaft, a connecting rod and a rod holder. The rotating shaft comprises a handle at least one of two opposite ends thereof. The connecting rod is pivotally connected to the rotating shaft. The rod holder is pivotally connected to the connecting rod. The rod holder comprises a first rod and a second rod respectively downwardly extended from two opposite lateral sides thereof. The rotating shaft is rotatable by the handle to move the connecting rod in rotating the rod holder to reverse the position of the first rod and the position of the second rod. The handle is selectively movable to a first position, a second position and a third position.

Further, the block member comprises a protruding rod. When the handle of the control mechanism is moved to the first position, the first rod is forced against the protruding rod to move the block member forward, enabling the push block to be moved to the rear side relative to the first tooth when the power break holder and the block member are lowered. When the handle of the control mechanism is moved to the second position, the first rod is disposed at one lateral side relative to the protruding rod and the block member is immovable, and therefore the push block is moved to the rear side of the second tooth when the power break holder and the block member are lowered.

Further, the block member comprises a protruding rod. The swing bar comprises an extension rod at a top side thereof. When the handle of the control mechanism is moved to the third position, the first rod is moved backwardly away from the protruding rod, the block member is immovable, and the second rod is forced against the extension rod to move the swing bar forward, enabling the push block to be moved to the front side relative to the second tooth when the power break holder and the block member are lowered.

In another embodiment of the present invention, the electric toy gun comprises a trigger, a power break holder, a power contact holder, a gearwheel set, a swing bar, and a link movable by the trigger to push the power break holder into contact with the power contact holder and to further turn on a power supply. The gearwheel set is rotated to cause the swing bar to swing when the power supply is turned on. The swing bar comprises an actuation portion at a top side thereof. The power break holder is movable away from the power contact holder to turn off the power supply. Further, the link comprises a coupling portion and a stop portion. The coupling portion is pivotally connected to the trigger such that when the trigger is pressed by an external force, the coupling portion is lifted, and the stop portion is lowered. Further, the power break holder comprises a block member horizontally slidably coupled to a top side thereof. The block member comprises a first tooth at one lateral side thereof. The block member is movable downwardly by the stop portion to lower the power break holder into contact with the power contact holder and to further turn on the power supply. The block member is disposed at one lateral side relative to the actuation portion of the swing bar when lowered. Further, the swing bar comprises a push block connected to the actuation portion and disposed at a rear side relative to the first tooth. The push block is forced against the first tooth to move the block member forwardly away from the stop portion of the link for enabling the power break holder to be moved away from the power contact holder to turn off the power supply when the swing bar is moved to push the actuation portion forward.

In still another embodiment of the present invention, the electric toy gun comprises a trigger, a power break holder, a power contact holder, a gearwheel set, a swing bar, and a link movable by the trigger to push the power break holder into contact with the power contact holder and to further turn on a power supply. The gearwheel set is rotated to cause the swing bar to swing when the power supply is turned on. The swing bar comprises an actuation portion at a top side thereof. The power break holder is movable away from the power contact holder to turn off the power supply. Further, the link comprises a coupling portion and a stop portion. The coupling portion is pivotally connected to the trigger such that when the trigger is pressed by an external force, the coupling portion is lifted, and the stop portion is lowered. Further, the power break holder comprises a block member horizontally slidably coupled to a top side thereof. The block member comprises a first tooth and a second tooth disposed at one lateral side thereof. The second tooth is disposed at a front side relative to the first tooth. The block member is movable downwardly by the stop portion to lower the power break holder into contact with the power contact holder and to further turn on the power supply. The block member is disposed at one lateral side relative to the actuation portion of the swing bar when lowered. Further, the swing bar comprises a push block connected to the actuation portion and disposed at a rear side relative to the second tooth. The push block is forced against the second tooth to move the block member forward when the swing bar is forced to move the actuation portion forward, and the push block is moved to the rear side relative to the first tooth after forward movement of the block member, and the swing bar is moved to force the push block against the first tooth in moving the block member away from the stop portion of the link, enabling the power break holder to be moved away from the power contact holder to further turn off the power supply.

In still another embodiment of the present invention, the electric toy gun comprises a trigger, a power break holder, a power contact holder, a gearwheel set, a swing bar, and a link movable by the trigger to push the power break holder into contact with the power contact holder and to further turn on a power supply. The gearwheel set is rotated to cause the swing bar to swing when the power supply is turned on. The swing bar comprises an actuation portion at a top side thereof. The power break holder is movable away from the power contact holder to turn off the power supply. Further, the link comprises a coupling portion and a stop portion. The coupling portion is pivotally connected to the trigger such that when the trigger is pressed by an external force, the coupling portion is lifted, and the stop portion is lowered. Further, the power break holder comprises a block member horizontally slidably coupled to a top side thereof. The block member comprising a first tooth and a second tooth disposed at one lateral side thereof. The second tooth is disposed at a front side relative to the first tooth. The block member is movable downwardly by the stop portion to lower the power break holder into contact with the power contact holder and to further turn on the power supply. The block member is disposed at one lateral side relative to the actuation portion of the swing bar when lowered. Further, the swing bar comprises a push block connected to the actuation portion and disposed at a front side relative to the second tooth. When the swing bar is driven to move the actuation portion forward, the push block is kept away from the first tooth and the second tooth, and the actuation portion of the swing bar is continuously moved back and forth, and when said trigger is released, said coupling portion of said link is lowered and said stop portion is lifted, causing said power break holder to be moved upwardly away from said power contact holder to turn off said power supply.

Preferably, the block member is disposed above the power break holder, and a first return spring is horizontally connected between the block member and the power break holder for enabling the block member to be automatically returned after having been moved forward.

Preferably, the first tooth of the block member has a beveled edge located at a front side thereof, and a second return spring is provided between the push block and the actuation portion of the swing bar. Thus, when the power break holder and the block member are lowered and the push block is moved to the rear side relative to the second tooth, the push block pushes the second tooth to move the block member forward, and then the second return spring forces the push block to move along the beveled edge to the rear side relative to the first tooth.

Thus, subject to the aforesaid arrangement of the trigger, the power break holder, the power contact holder, the gearwheel set, the swing bar and the control mechanism, the electric toy gun can be selected to perform the single fire mode, the dual fire mode, or the continuous fire mode, providing a high level of realistic simulation, satisfying the needs of consumers, and enhancing product competitiveness in the global market.

The other object of this invention is subject to the aforesaid arrangement of the trigger, the power break holder, the power contact holder, the gearwheel set and the swing bar, the electric toy gun can be single to perform the single fire mode, the dual fire mode, or the continuous fire mode, providing a high level of realistic simulation, satisfying the needs of consumers, and enhancing product competitiveness in the global market.

DETAILED DESCRIPTION OF THE PREFERRED EMBODIMENT

Figure 1:
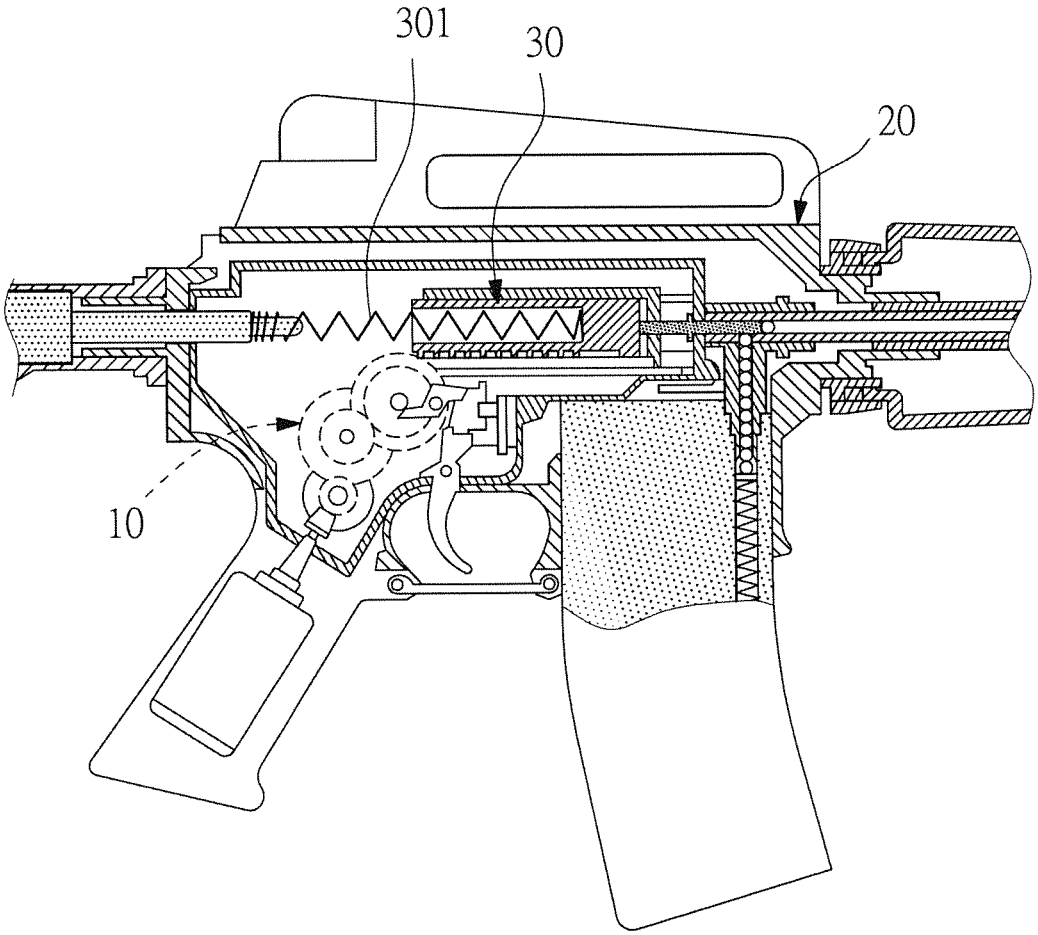
FIG. 1 (PRIOR ART)
FIG. 1 is a structural plain view of a driving structure of an electric toy gun according to the prior art.
Figure 2:
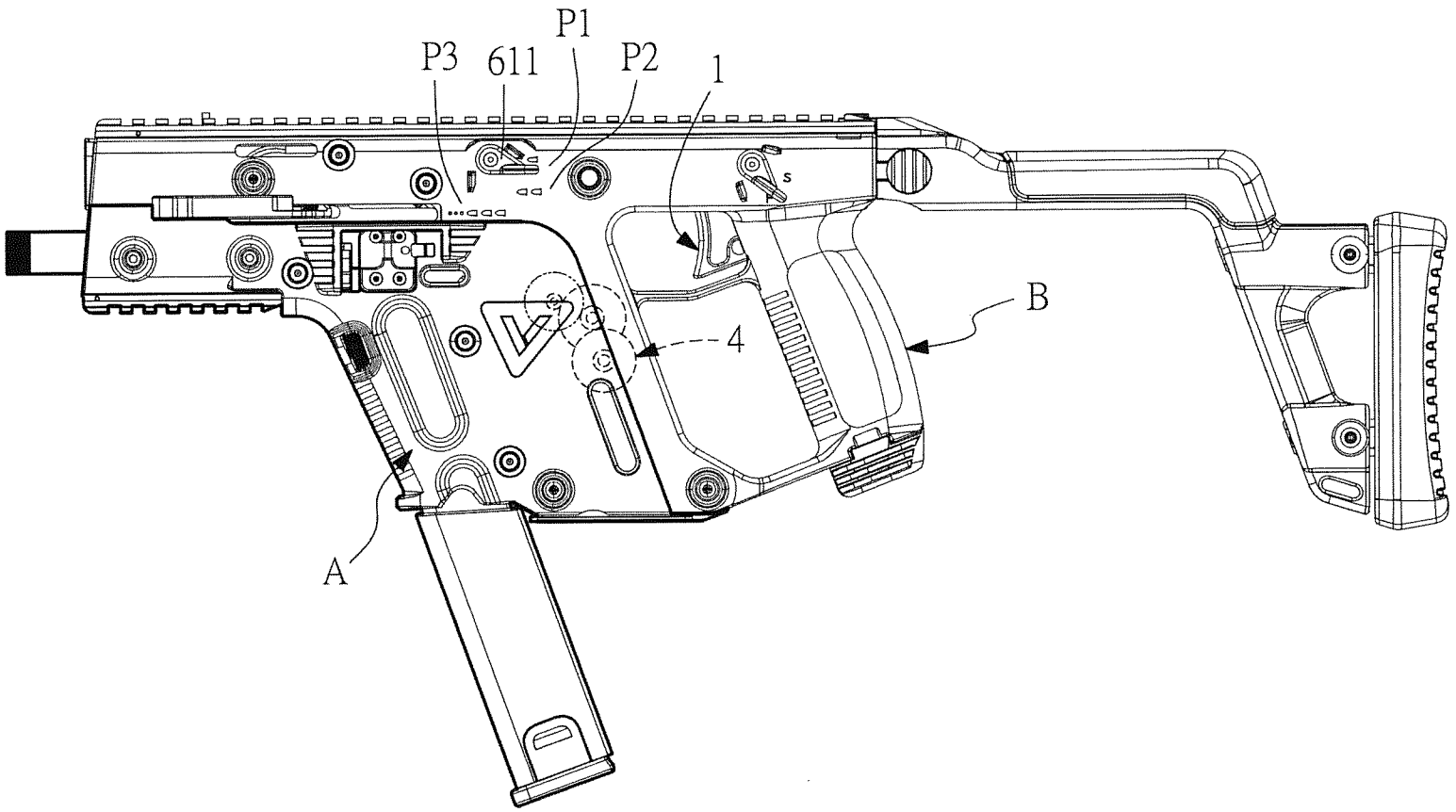
FIG. 2 is a schematic plain view of an electric toy gun in accordance with the present invention.

Referring to FIG. 2, an electric toy gun in accordance with the present invention is shown.

Figure 3:
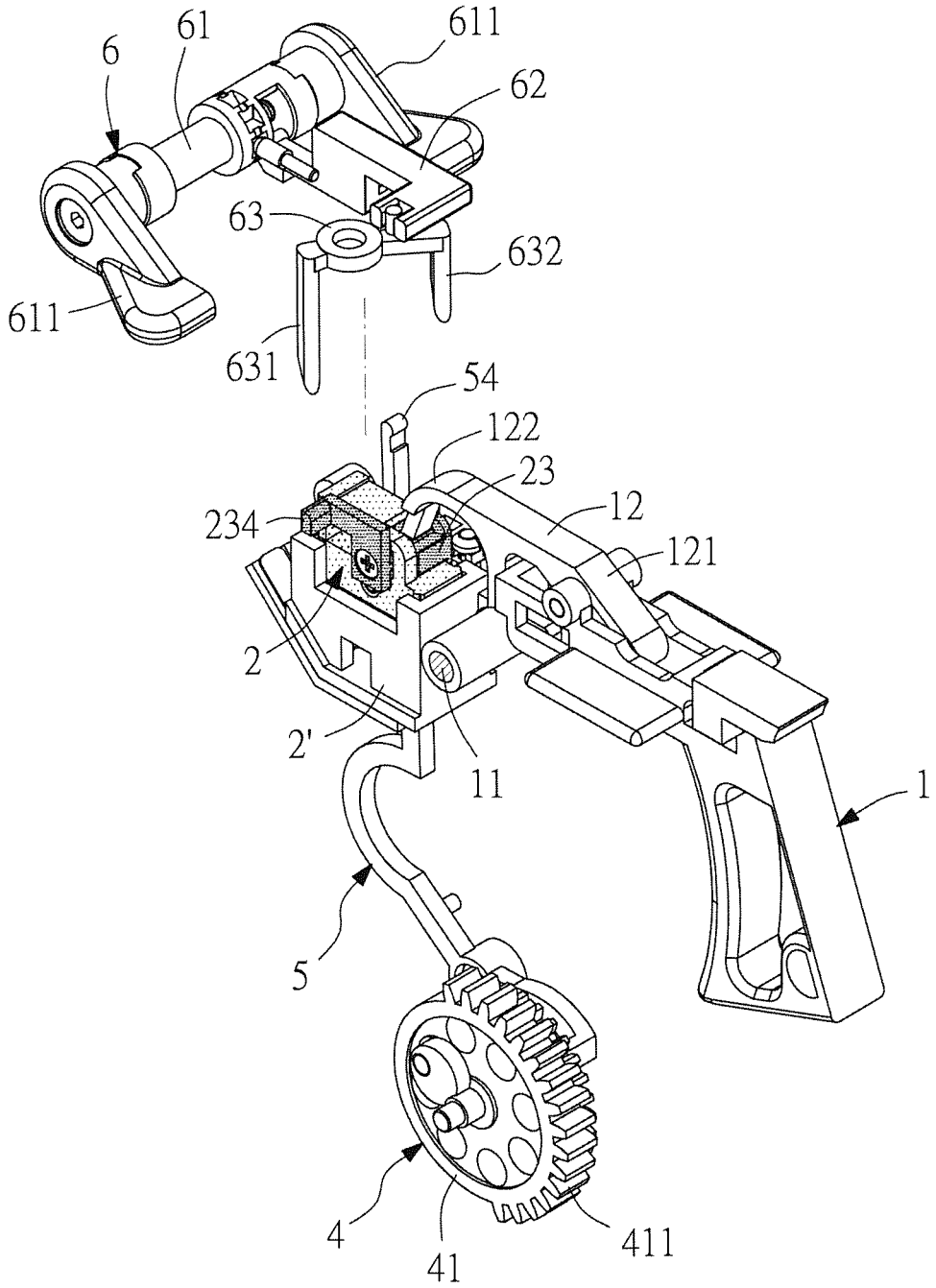
FIG. 3 is an exploded view of the major part of the electric toy gun in accordance with the present invention.
Figure 4:
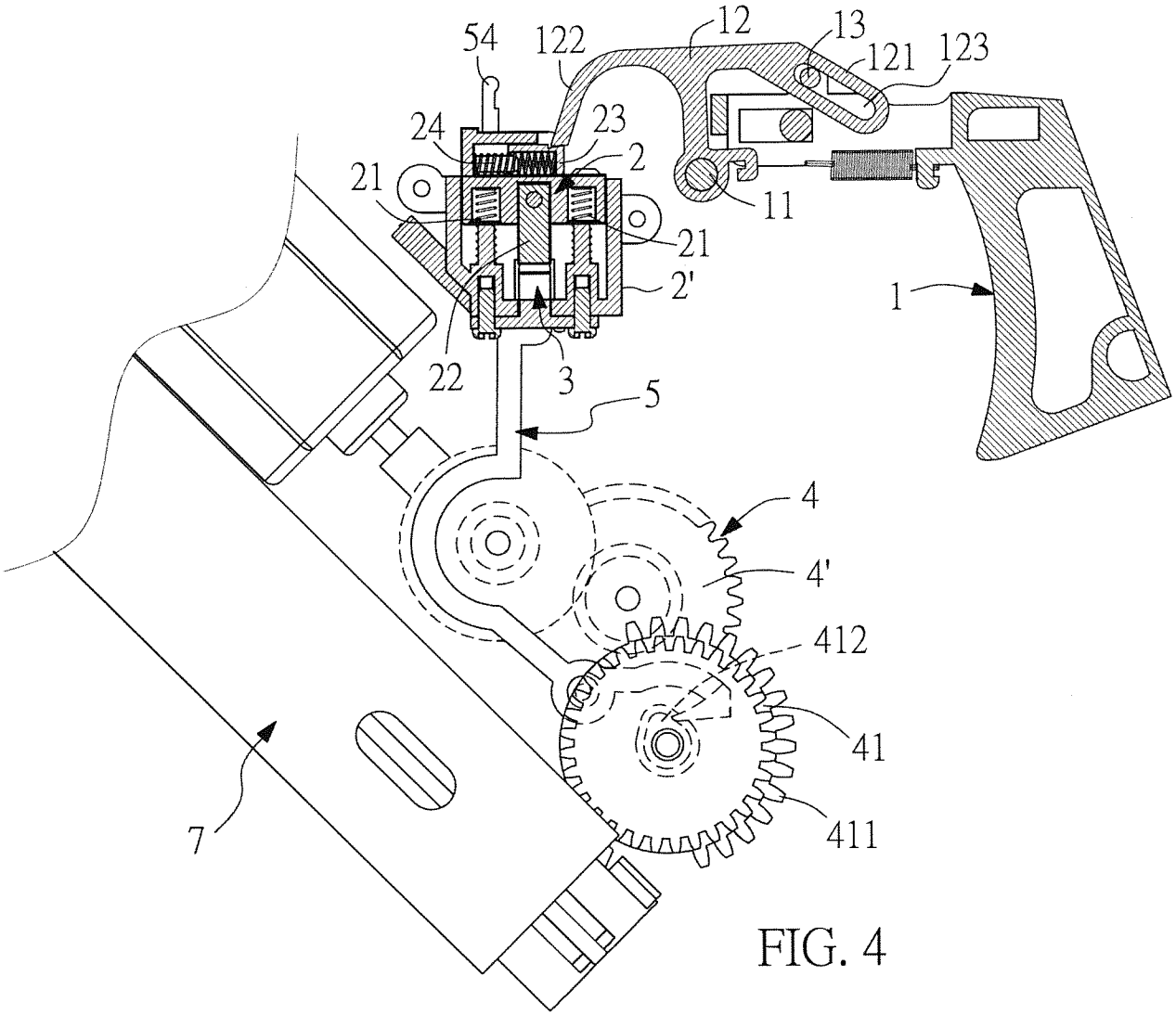
FIG. 4 is a plain view of the assembly shown in FIG. 3.

Referring to FIGS. 3 and 4 and FIG. 2 again, the electric toy gun comprises a primary gun body A and a secondary gun body B (see FIG. 3), a trigger 1, a power break holder 2, a power contact holder 3 (see FIG. 4), a gearwheel set 4, a swing bar 5, and a control mechanism 6, and a piston set 7 (see FIG. 4).

The trigger 1 (see FIGS. 3 and 4) is mounted within the secondary gun body B (see FIG. 2), having an axle 11 located at a front side thereof and coupled to a link 12. The link 12 has a middle part thereof pivotally coupled to the axle 11, a rear end thereof terminating in a coupling portion 121, and a front end thereof terminating in a stop portion 122. The link 12 further comprises an oblong slot 123 formed in the coupling portion 121 and sloping backwardly downwards (see FIG. 4). The oblong slot 123 is coupled to a push rod 13. If the trigger 1 is not pressed, the coupling portion 121 is lowered (see FIG. 4) and the stop portion 122 is lifted. On the contrary, if the trigger 1 is pressed, the push rod 13 is moved backwards along the oblong slot 123, causing the coupling portion 121 of the link 12 to be lifted (see FIG. 5) and the stop portion 122 to be lowered.

The power break holder 2 (see FIGS. 3 and 4) is mounted in a holder shell 2' and supported on plural spring members 21 within the holder shell 2'. Thus, the power break holder 2 can be forced down to compressed the spring members 21 and then returned to its former position by the spring members 21 when the pressure is released from the spring members 21 (see FIGS. 4 and 5). Further, the power break holder 2 comprises a metal conducting rod 22 downwardly mounted at a bottom side thereof, a block member 23 horizontally slidably coupled to a top side thereof, and a first return spring 24 mounted at the top side and connected to the block member 23 for returning the block member 23 after the block member 23 having be pushed forward. The block member 23 comprises a first tooth 231 and a second tooth 232 located at one lateral side thereof, and a protruding rod 234 located at an opposite side thereof (see FIG. 6). The second tooth 232 is disposed at a front side relative to the first tooth 231. Further, the first tooth 231 defines a beveled edge 233 at a front side thereof. When the stop portion 122 of the link 12 is lowered, it forces the block member 23 and the power break holder 2 downwards (see FIG. 5).

The power contact holder 3 protrudes over the bottom wall of the holder shell 2' below the metal conducting rod 22 of the power break holder 2 (see FIGS. 4 and 5). Thus, when the block member 23 and the power break holder 2 are lowered, the metal conducting rod 22 is plugged into the power contact holder 3 to turn on power supply. On the contrary, when the power break holder 2 is moved upwardly back to its former position, the power is turned off.

The gearwheel set 4 is a combination of a first gearwheel 41 and a gear train 4'. The first gearwheel 41 comprises a gear sector 411 for driving the piston set 7. When the first gearwheel 41 is rotated to the position where the gear sector 411 is disengaged from the piston set 7, the piston set 7 is immediately returned to its former position, enabling a toy bullet to be fired out of the gun barrel to complete a firing action (this firing action is of the known art, therefore no illustration is provided). As soon as the first gearwheel 41 is rotated to the position where the gear sector 411 is forced into engagement with the piston set 7 again, a next firing action is ready. Further, the first gearwheel 41 comprises a cam 412 at the center of one lateral side thereof.

Figure 6:
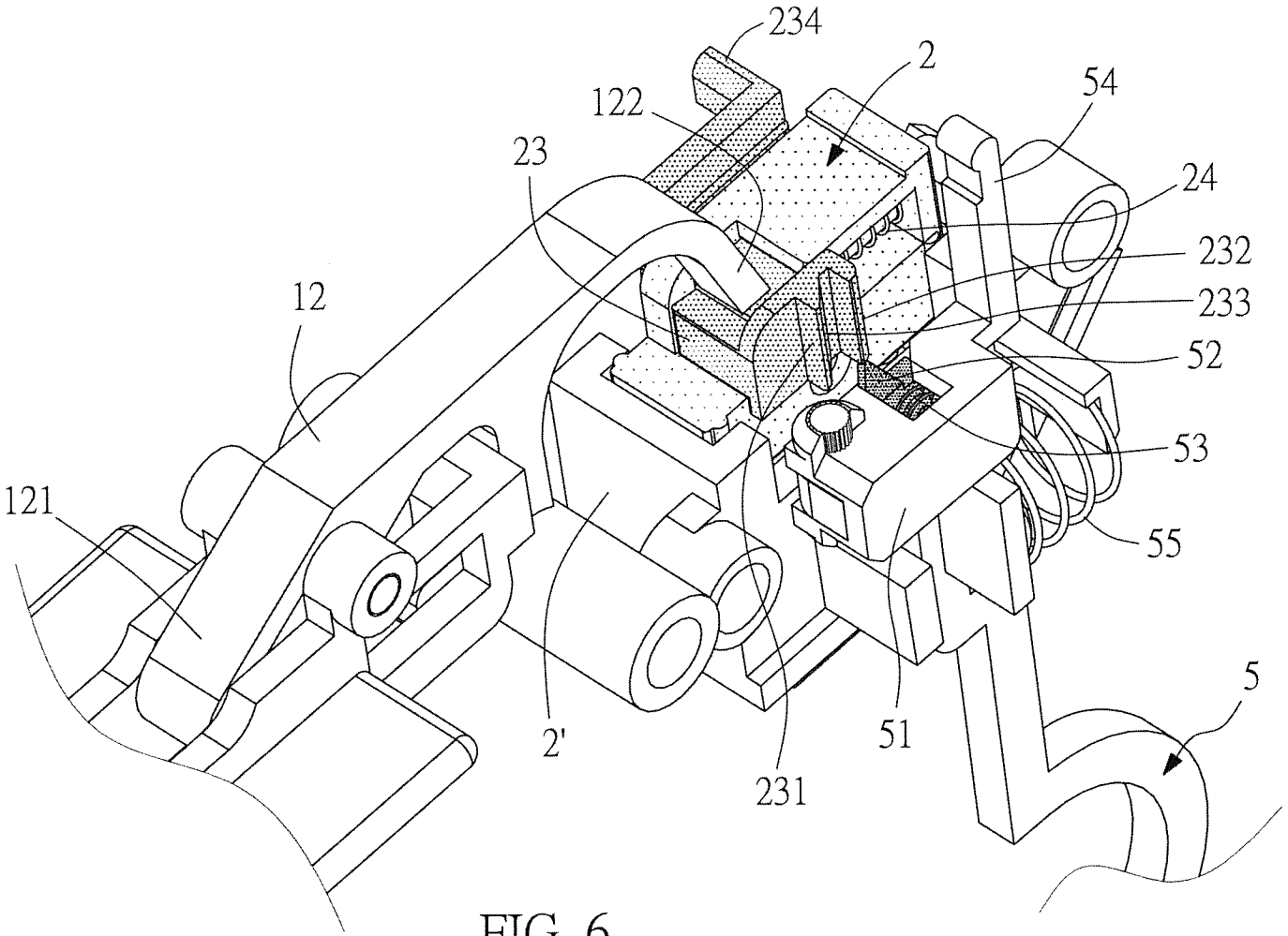
FIG. 6 is an enlarged scale of a part of FIG. 3 and showing the other side view.
Figure 7:
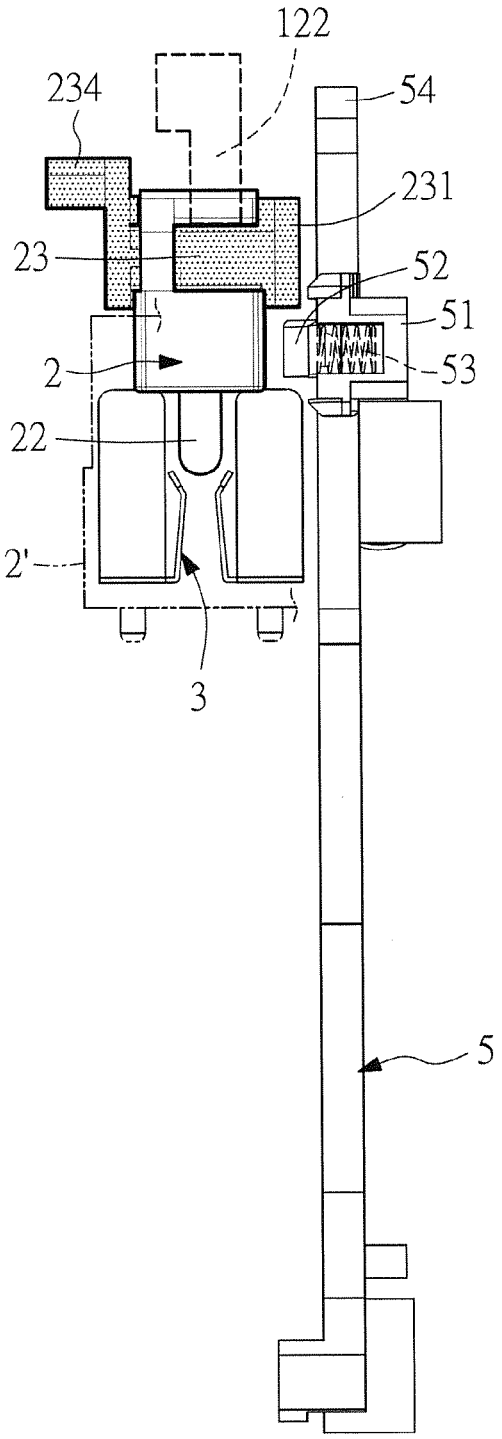
FIG. 7 is a schematic structural plain view of the present invention, illustrating the trigger immovable.
Figure 8:
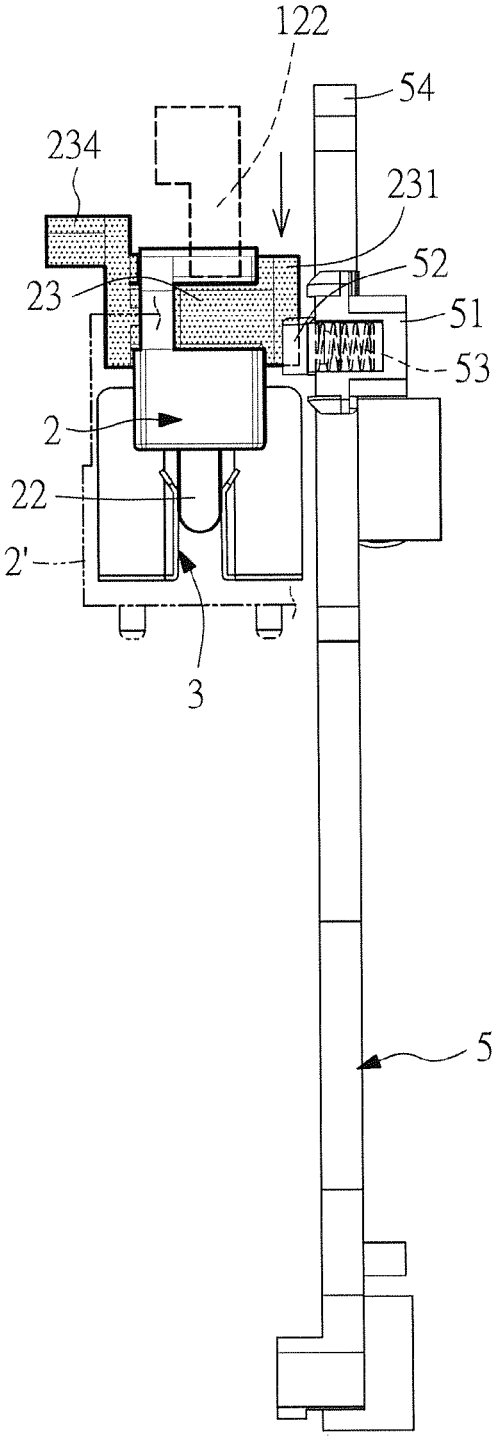
FIG. 8 corresponds to FIG. 7, illustrating the trigger pressed.
Figure 9:
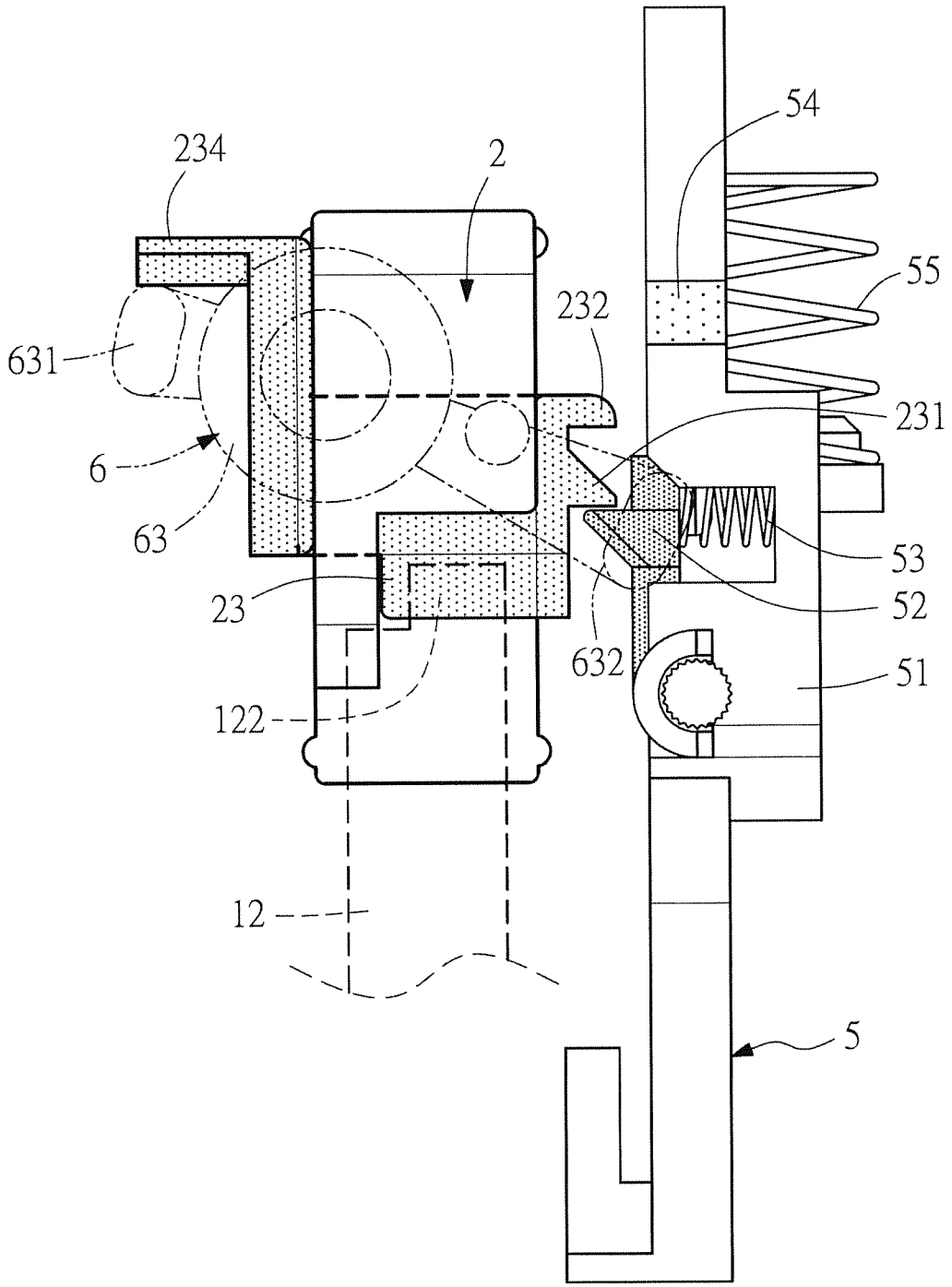
FIG. 9 is a schematic top view of the block member and push block of the electric toy gun in accordance with the present invention during the single fire mode.
Figure 11:
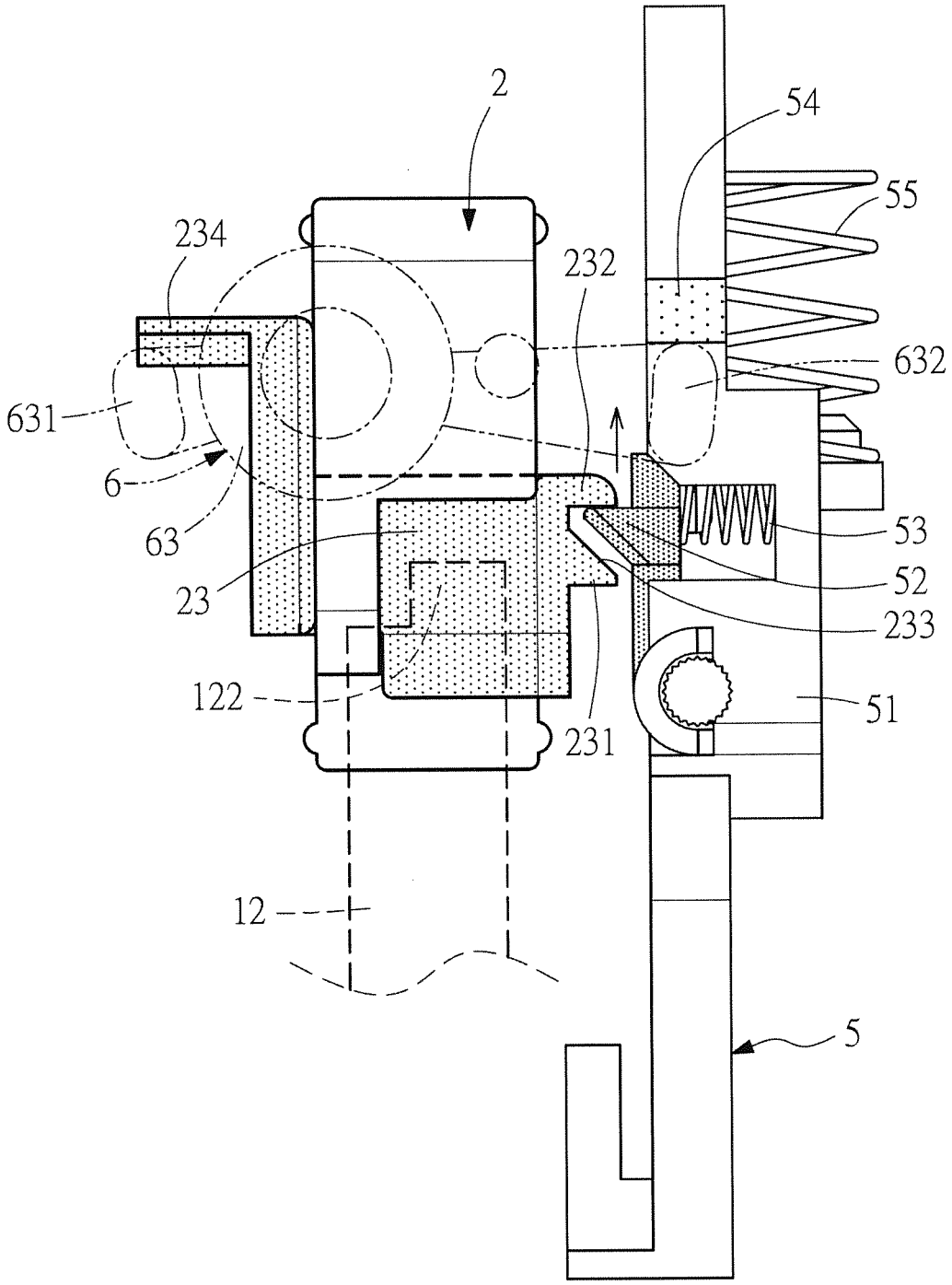
FIG. 11 is a schematic top view of the block member and push block of the electric toy gun in accordance with the present invention during the first shot under the dual fire mode.
Figure 13:
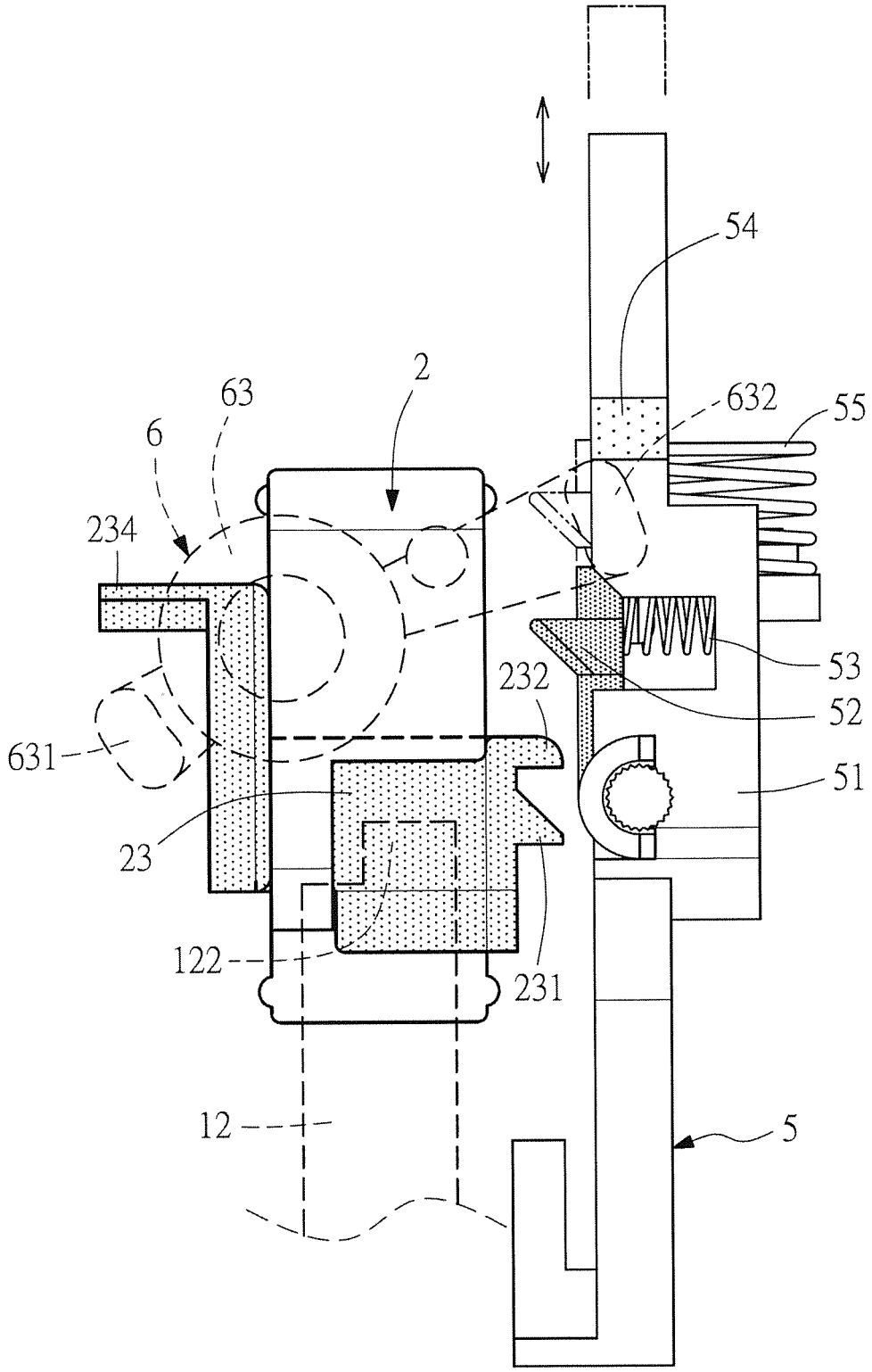
FIG. 13 is a schematic top view of the block member and push block of the electric toy gun in accordance with the present invention during the continuous fire mode.

The swing bar 5 has a lower part thereof pivotally connected to a fixed point, and a bottom end thereof pressed on the cam 412 of the first gearwheel 41. Therefore, when the first gearwheel 41 rotates through one turn to finish one firing action, the swing bar 5 is driven to complete one swinging cycle (see FIG. 5). The swing bar 5 comprises an actuation portion 51 located at a top side thereof, a push block 52 slidably coupled to the actuation portion 51, and a second return spring 53 connected between the actuation portion 51 and the push block 52 (see FIGS. 6 and 7). When the stop portion 122 of the link 12 is lowered to force the block member 23 and the power break holder 2 downwards, the block member 23 is disposed at one lateral side of the actuation portion 51 (see FIG. 8), and the push block 52 can be disposed at a rear side relative to the first tooth 231 (see FIG. 9), or a rear side relative to the second tooth 232 (see FIG. 11), or a front side relative to the second tooth 232 (see FIG. 13). The swing bar 5 further comprises an extension rod 54 extended from the top side thereof. Further, the swing bar 5 has its front side stopped against a third return spring 55 (see FIG. 6). After the swing bar 5 has been moved forward, the third return spring 55 immediately pushes the swing bar 5 back to its former position.

The control mechanism 6 comprises a rotating shaft 61, a connecting rod 62, and a rod holder 63. The rotating shaft 61 has a handle 611 provided at one or each of two opposite ends thereof (in the embodiment shown in FIG. 3, two levers are respectively provided at the two opposite ends of the rotating shaft). The connecting rod 62 is pivotally connected to the rotating shaft 61. The rod holder 63 is pivotally connected to the connecting rod 62. The rod holder 63 comprises a first rod 631 and a second rod 632 respectively downwardly extended from two opposite lateral sides thereof. When biasing one handle 611 to rotate the rotating shaft 61, the connecting rod 62 will be forced to move the rod holder 63, thereby reversely biasing the first rod 631 and the second rod 632. Further, the handle 611 can be selectively biased to a first position P1, a second position P2, or a third position P3 (see FIG. 2). When the handle 611 is biased to the first position P1, the first rod 631 pushes the protruding rod 234 to move the block member 23 forward (see FIG. 9), and thus, when the power break holder 2 and the block member 23 are lowered, the push block 52 is shifted to the rear side relative to the first tooth 231. When the handle 611 is biased to the second position P2, the first rod 631 is shifted to one lateral side relative to the protruding rod 234 (see FIG. 11) without moving the block member 23, and thus, when the power break holder 2 and the block member 23 are lowered, the push block 52 is shifted to the rear side relative to the second tooth 232. When the handle 611 is biased to the third position P3, the first rod 631 is moved backwards without moving the block member 23 (see FIG. 13), and the second rod 632 is moved forwards to push the extension rod 54 of the swing bar 5, and thus, when the power break holder 2 and the block member 23 are lowered, the push block 52 is shifted to the front side relative to the second tooth 232. Thus, the control mechanism 6 can be controlled to adjust the horizontal position of the block member 23.

By means of selectively biasing the handle 611 of the control mechanism 6 to the first position P1, the second position P2 or the third position P3 (see FIG. 2) and then pressing the trigger 1 to lower the power break holder 2 and the block member 23, the block member 23 can be shifted to one lateral side of the actuation portion 51, and the push block 52 can be shifted to the rear side relative to the first tooth 231 (see FIG. 9), the rear side relative to the second tooth 232 (see FIG. 11), or the front side relative to the second tooth 232 (see FIG. 13), performing the single fire mode, the dual fire mode or the continuous fire mode.

The operation of the single fire mode, the dual fire mode and the continuous fire mode are outlined thereinafter.

Figure 5:
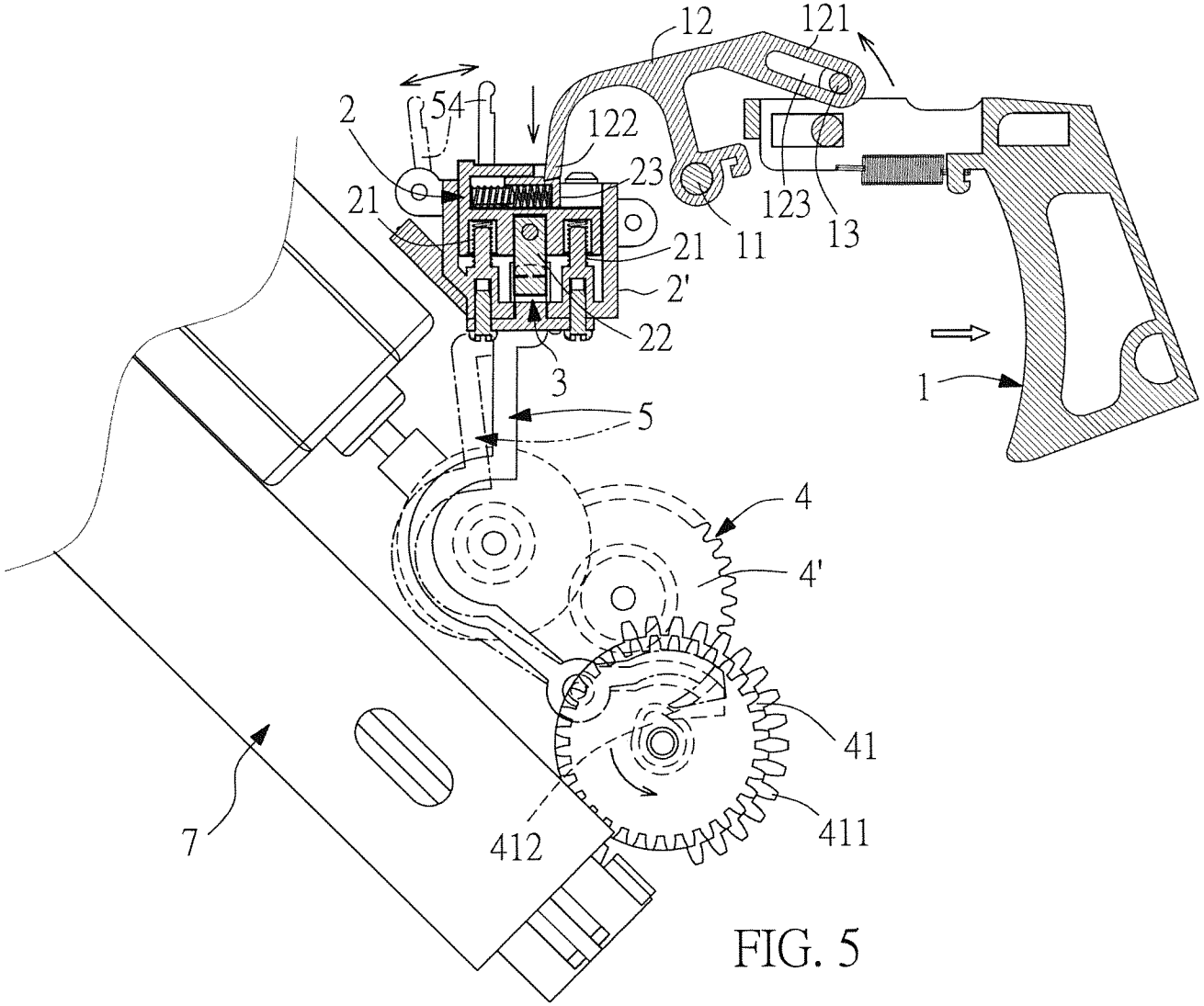
FIG. 5 corresponds to FIG. 4, illustrating the trigger pressed.
Figure 10:
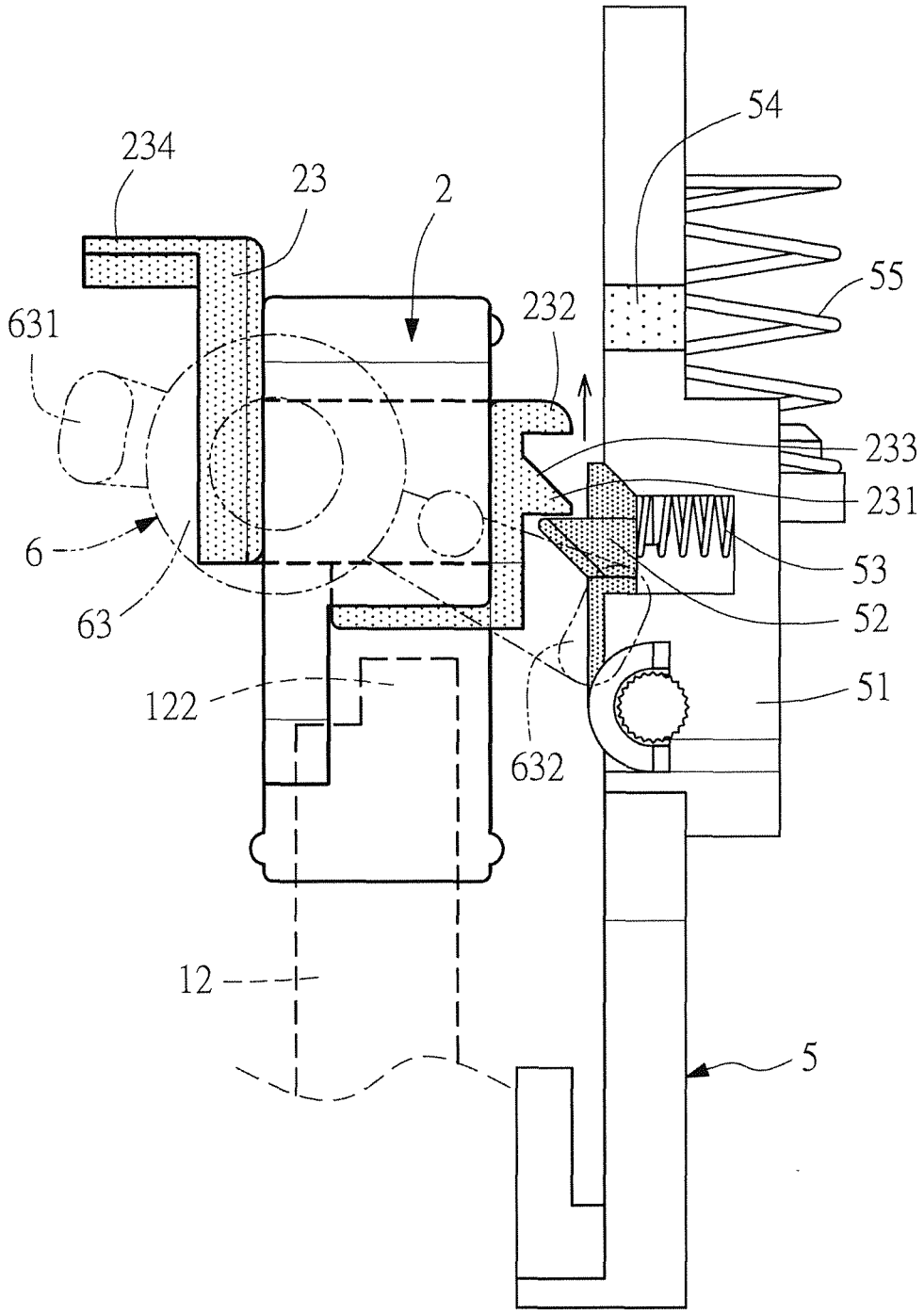
FIG. 10 corresponds to FIG. 9, illustrating the block member moved forward.

When pressed the trigger 1, the link 12 is forced to lower the block member 23 and the power break holder 2, forcing the power break holder 2 to conduct the power contact holder 3 and to further turn on power supply (see FIG. 5). If the push block 52 is at the rear side relative to the first tooth 231 at this time (see FIG. 9), the gearwheel set 4 is rotated to conduct a single-shot firing action (single fire mode), causing the swing bar 5 to swing. At the moment the swing bar 5 swings forward, the push block 52 is moved with the actuation portion 51 to push the first tooth 231 (see FIG. 10), and the block member 23 is immediately moved forward and released from the downward pressure of the stop portion 122 of the link 12. Thereafter, the power break holder 2 is returned by the spring member 21 (see FIGS. 4 and 5) and disconnected from the power contact holder 3 to turn off power supply, and thus one cycle of the single fire mode is finished.

Figure 12:
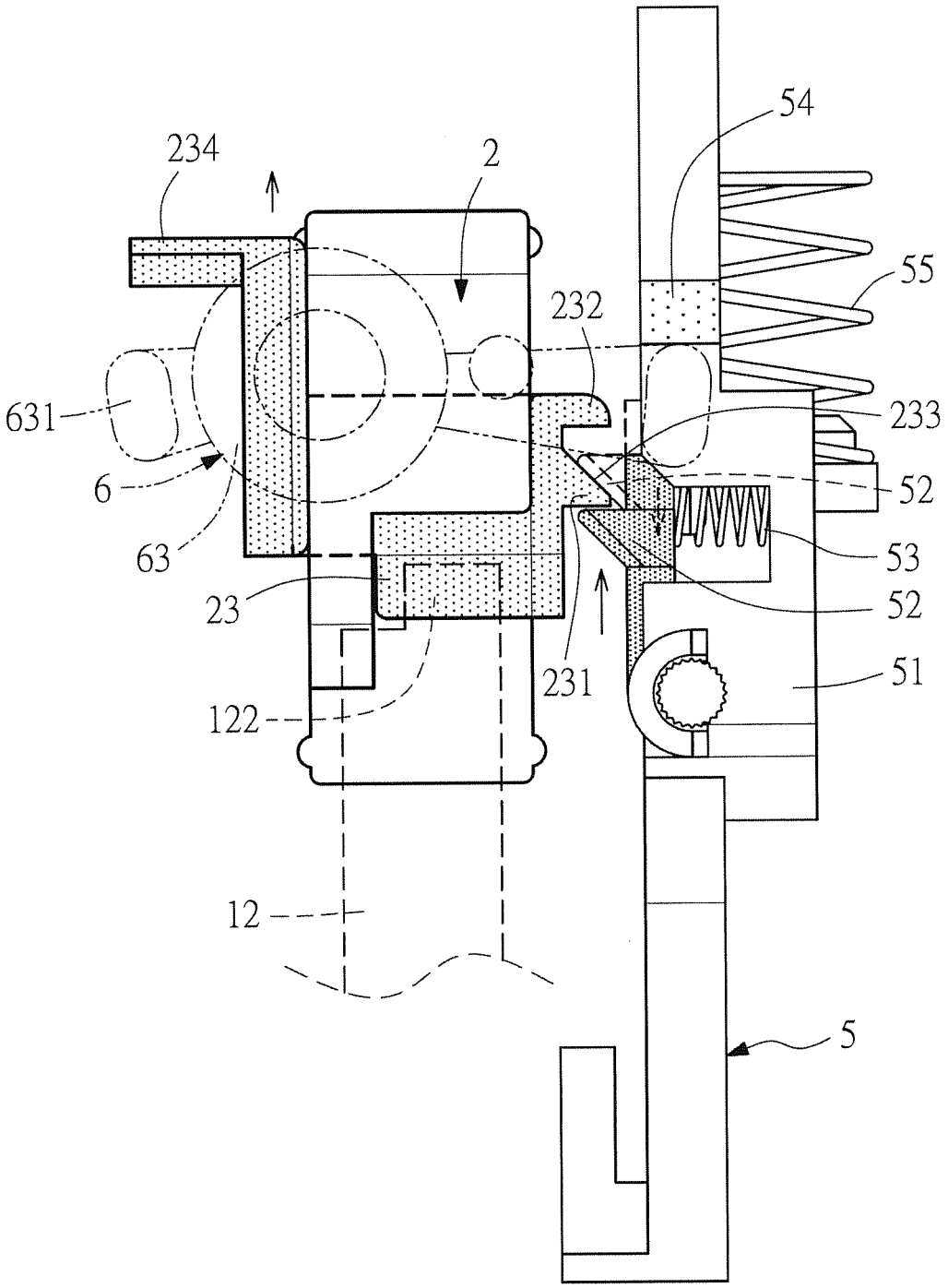
FIG. 12 corresponds to FIG. 11 when in the second shot under the dual fire mode.

Further, if the push block 52 is at the rear side relative to the second tooth 232 (see FIG. 11) when the block member 23 and the power break holder 2 are lowered to the position where the power break holder 2 touches the power contact holder 3 to turn on power supply (see FIG. 5), the gearwheel set 4 is rotated to conduct a dual-shot firing action (dual fire mode). When the gearwheel set 4 is rotated at this time, the swing bar 5 will be forced to swing back and forth. When the swing bar 5 swings forward (to initiate a primary firing action), the push block 52 is moved with the actuation portion 51 to push the second tooth 232 forward (see FIG. 11), causing the block member 23 to move forward. After forward displacement of the block member 23, the push block 52 is forced by the second return spring 53 to move along the beveled edge 233 to the rear side relative to the first tooth 231 (see FIG. 12). Thereafter, the first gearwheel 41 is rotated again to cause the swing bar 5 to swing, causing the push block 52 to push the first tooth 231 forward. At this time, the block member 23 is pushed forward and released from the downward pressure of the stop portion 122 of the link 12 (the block member is moved forward to the position shown in FIG. 10), and the power break holder 2 is pushed upwardly away from the power contact holder 3 to turn off power supply, and thus one cycle of the dual fire mode is finished.

Further, if the push block 52 is at the front side relative to the second tooth 232 (see FIG. 13) when the block member 23 and the power break holder 2 are lowered to the position where the power break holder 2 touches the power contact holder 3 to turn on power supply (see FIG. 5), the gearwheel set 4 is rotated to conduct a continuous firing action (continuous fire mode). When the gearwheel set 4 is rotated at this time, the swing bar 5 will be forced to swing continuously back and forth. When the actuation portion 51 moves forward during swinging of the swing bar 5, the push block 52 does not push the first tooth 231 and the second tooth 232, and therefore the gearwheel set 4 keeps rotating, causing the actuation portion 51 of the swing bar 5 to continuously move back and forth, and toy bullets are continuously fired. When the user releases the trigger 1, the stop portion 122 of the link 12 is lifted, causing the power break holder 2 to be moved upwardly away from the power contact holder 3, and therefore the power supply is turned off.

As stated above, subject to proper arrangement of the trigger 1, the power break holder 2, the power contact holder 3, the gearwheel set 4 and the swing bar 5 and the control of the control mechanism 6, the electric toy gun of the present invention can be controlled to perform the single fire mode, the dual fire mode or the continuous fire mode, providing a high level of realistic simulation, satisfying the needs of consumers, and enhancing product competitiveness in the global market.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric toy gun, comprising a trigger, a power break holder, a power contact holder, a gearwheel set, a swing bar, a control mechanism, and a link movable by said trigger to push said power break holder into contact with said power contact holder and to further turn on a power supply, said gearwheel set being rotated to cause said swing bar to swing when said power supply is turned on, said swing bar comprising an actuation portion at a top side thereof, said power break holder being movable away from said power contact holder to turn off said power supply, wherein:

said link comprises a coupling portion and a stop portion, said coupling portion being pivotally connected to said trigger such that when said trigger is pressed by an external force, said coupling portion is lifted, and said stop portion is lowered;

said power break holder comprises a block member horizontally slidably coupled to a top side thereof, said block member comprising a first tooth and a second tooth at one lateral side thereof, said second tooth being disposed at a front side relative to said first tooth, said block member being movable downwardly by said stop portion to lower said power break holder into contact with said power contact holder and to further turn on said power supply, said block member being disposed at one lateral side relative to said actuation portion of said swing bar when moved down by said stop portion; said swing bar comprises a push block connected to said actuation portion; said control mechanism is controllable to move said block member in one of three positions, enabling said push block to be selectively shifted to a rear side relative to said first tooth, a rear side relative to said second tooth or a front side relative to said second tooth when said power break holder and said block member are lowered; when said push block is at the rear side relative to said first tooth and said swing bar is moved to push said actuation portion forward, said push block pushes said first tooth forward, causing said block member to be moved forwardly away from said stop portion of said link and said power break holder to be moved away from said power contact holder to turn off said power supply; when said push block is at the rear side relative to said second tooth and said swing bar is moved to push said actuation portion forward, said push block pushes said second tooth, causing said block member to be moved forward and said push block to be forced move to the rear side relative to said first tooth, and said swing bar is moved again to force said push block of said actuation portion to push said first tooth forward, causing said block member to be moved away from said stop portion of said link and said power break holder to be moved away from said power contact holder to turn off said power supply; when said push block is at the front side relative to said second tooth and said swing bar is moved to push said actuation portion forward, said push block is kept away from said first tooth and said second tooth and said actuation portion of said swing bar is continuously moved back and forth, and said coupling portion of said link is lowered and said stop portion is lifted when said trigger is released, and therefore said power break holder is moved upwardly away from said power contact holder to turn off said power supply.

2. The electric toy gun as claimed in claim 1, wherein said block member is disposed above said power break holder; a first return spring is horizontally provided between said block member and said power break holder for enabling said block member to be automatically returned after said block member having been moved forward.

3. The electric toy gun as claimed in claim 2, wherein said first tooth of said block member has a beveled edge located at a front side thereof; a second return spring is provided between said push block and said actuation portion of said swing bar such that when said power break holder and said block member are lowered and said push block is moved to the rear side relative to said second tooth, said push block pushes said second tooth to move said block member forward, and then said second return spring forces said push block to move along said beveled edge to the rear side relative to said first tooth.

4. The electric toy gun as claimed in claim 3, wherein said control mechanism comprises a rotating shaft, a connecting rod and a rod holder, said rotating shaft comprises a handle at least one of two opposite ends thereof, said connecting rod being pivotally connected to said rotating shaft, said rod holder being pivotally connected to said connecting rod, said rod holder comprising a first rod and a second rod respectively downwardly extended from two opposite lateral sides thereof, said rotating shaft being rotatable by said handle to move said connecting rod in rotating said rod holder to reverse the position of said first rod and the position of said second rod, said handle being selectively movable to a first position, a second position and a third position.

5. The electric toy gun as claimed in claim 4, wherein said block member comprises a protruding rod; when said handle of said control mechanism is moved to said first position, said first rod is forced against said protruding rod to move said block member forward, enabling said push block to be moved to the rear side relative to said first tooth when said power break holder and said block member are lowered.

6. The electric toy gun as claimed in claim 4, wherein said block member comprises a protruding rod; when said handle of said control mechanism is moved to said second position, said first rod is disposed at one lateral side relative to said protruding rod and said block member is immovable, and therefore said push block is moved to the rear side of said second tooth when said power break holder and said block member are lowered.

7. The electric toy gun as claimed in claim 1, wherein said block member comprises a protruding rod; said swing bar comprises an extension rod at a top side thereof; when said handle of said control mechanism is moved to said third position, said first rod is moved backwardly away from said protruding rod, said block member is immovable, and said second rod is forced against said extension rod to move said swing bar forward, enabling said push block to be moved to the front side relative to said second tooth when said power break holder and said block member are lowered.

8. An electric toy gun, comprising a trigger, a power break holder, a power contact holder, a gearwheel set, a swing bar, and a link movable by said trigger to push said power break holder into contact with said power contact holder and to further turn on a power supply, said gearwheel set being rotated to cause said swing bar to swing when said power supply is turned on, said swing bar comprising an actuation portion at a top side thereof, said power break holder being movable away from said power contact holder to turn off said power supply, wherein:

said link comprises a coupling portion and a stop portion, said coupling portion being pivotally connected to said trigger such that when said trigger is pressed by an external force, said coupling portion is lifted, and said stop portion is lowered;

said power break holder comprises a block member horizontally slidably coupled to a top side thereof, said block member comprising a first tooth at one lateral side thereof, said block member being movable downwardly by said stop portion to lower said power break holder into contact with said power contact holder and to further turn on said power supply, said block member being disposed at one lateral side relative to said actuation portion of said swing bar when lowered;

said swing bar comprises a push block connected to said actuation portion and disposed at a rear side relative to said first tooth, said push block being forced against said first tooth to move said block member forwardly away from said stop portion of said link for enabling said power break holder to be moved away from said power contact holder to turn off said power supply when said swing bar is moved to push said actuation portion forward.

9. An electric toy gun, comprising a trigger, a power break holder, a power contact holder, a gearwheel set, a swing bar, and a link movable by said trigger to push said power break holder into contact with said power contact holder and to further turn on a power supply, said gearwheel set being rotated to cause said swing bar to swing when said power supply is turned on, said swing bar comprising an actuation portion at a top side thereof, said power break holder being movable away from said power contact holder to turn off said power supply, wherein:

said link comprises a coupling portion and a stop portion, said coupling portion being pivotally connected to said trigger such that when said trigger is pressed by an external force, said coupling portion is lifted, and said stop portion is lowered;

said power break holder comprises a block member horizontally slidably coupled to a top side thereof, said block member comprising a first tooth and a second tooth disposed at one lateral side thereof, said second tooth being disposed at a front side relative to said first tooth, said block member being movable downwardly by said stop portion to lower said power break holder into contact with said power contact holder and to further turn on said power supply, said block member being disposed at one lateral side relative to said actuation portion of said swing bar when lowered;

said swing bar comprises a push block connected to said actuation portion and disposed at a rear side relative to said second tooth; said push block is forced against said second tooth to move said block member forward when said swing bar is forced to move said actuation portion forward, and said push block is moved to the rear side relative to said first tooth after forward movement of said block member, and said swing bar is moved to force said push block against said first tooth in moving said block member away from said stop portion of said link, enabling said power break holder to be moved away from said power contact holder to further turn off said power supply.

10. An electric toy gun, comprising a trigger, a power break holder, a power contact holder, a gearwheel set, a swing bar, and a link movable by said trigger to push said power break holder into contact with said power contact holder and to further turn on a power supply, said gearwheel set being rotated to cause said swing bar to swing when said power supply is turned on, said swing bar comprising an actuation portion at a top side thereof, said power break holder being movable away from said power contact holder to turn off said power supply, wherein:

said link comprises a coupling portion and a stop portion, said coupling portion being pivotally connected to said trigger such that when said trigger is pressed by an external force, said coupling portion is lifted, and said stop portion is lowered;

said power break holder comprises a block member horizontally slidably coupled to a top side thereof, said block member comprising a first tooth and a second tooth disposed at one lateral side thereof, said second tooth being disposed at a front side relative to said first tooth, said block member being movable downwardly by said stop portion to lower said power break holder into contact with said power contact holder and to further turn on said power supply, said block member being disposed at one lateral side relative to said actuation portion of said swing bar when lowered;

said swing bar comprises a push block connected to said actuation portion and disposed at a front side relative to said second tooth; when said swing bar is driven to move said actuation portion forward, said push block is kept away from said first tooth and said second tooth, and said actuation portion of said swing bar is continuously moved back and forth, and when said trigger is released, said coupling portion of said link is lowered and said stop portion is lifted, causing said power break holder to be moved upwardly away from said power contact holder to turn off said power supply.

11. The electric toy gun as claimed in claim 8, wherein said block member is disposed above said power break holder, and a first return spring is horizontally connected between said block member and said power break holder for enabling said block member to be automatically returned after having been moved forward.

12. The electric toy gun as claimed in claim 9, wherein said block member is disposed above said power break holder, and a first return spring is horizontally connected between said block member and said power break holder for enabling said block member to be automatically returned after having been moved forward.

13. The electric toy gun as claimed in claim 10, wherein said block member is disposed above said power break holder, and a first return spring is horizontally connected between said block member and said power break holder for enabling said block member to be automatically returned after having been moved forward.

14. The electric toy gun as claimed in claim 9, wherein said block member is disposed above said power break holder, and a first return spring is horizontally connected between said block member and said power break holder for enabling said block member to be automatically returned after having been moved forward; said first tooth of said block member has a beveled edge located at a front side thereof; a second return spring is provided between said push block and said actuation portion of said swing bar such that when said power break holder and said block member are lowered and said push block is moved to the rear side relative to said second tooth, said push block pushes said second tooth to move said block member forward, and then said second return spring forces said push block to move along said beveled edge to the rear side relative to said first tooth.

* * * * *